US007225786B2

(12) United States Patent
Kim

(10) Patent No.: US 7,225,786 B2
(45) Date of Patent: Jun. 5, 2007

(54) OIL DRAIN PASSAGE STRUCTURE OF CYLINDER BLOCK AND CORE STRUCTURE THEREOF

(75) Inventor: Jong-Won Kim, Gwangmyeong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 11/299,375

(22) Filed: Dec. 8, 2005

(65) Prior Publication Data

US 2006/0144353 A1 Jul. 6, 2006

(30) Foreign Application Priority Data

Dec. 21, 2004 (KR) ..... 10-2004-0109588

(51) Int. Cl.
*F02B 75/22* (2006.01)
*F01M 1/02* (2006.01)

(52) U.S. Cl. ..... 123/195 R; 123/196 R

(58) Field of Classification Search ..... 123/195 R, 123/196 R
See application file for complete search history.

(56) References Cited

U.S. PATENT DOCUMENTS 5,294,134 A * 3/1994 Kawaguchi et al. ..... 277/595
5,452,692 A 9/1995 Spray et al.
5,664,538 A 9/1997 Hutchins
5,727,512 A * 3/1998 Hutchins ..... 123/193.3
5,850,814 A 12/1998 Fenn et al.
5,852,992 A * 12/1998 Boggs et al. ..... 123/196 R
6,571,763 B1 6/2003 Bakker
2002/0062795 A1 * 5/2002 Inoue et al. ..... 123/41.1

FOREIGN PATENT DOCUMENTS

| | | |
|---|---|---|
| JP | 58-178819 | 10/1983 |
| JP | 59-079019 | 5/1984 |
| JP | 06-193502 | 7/1994 |
| JP | 10-089023 | 4/1998 |
| JP | 2003301742 A * | 10/2003 |

* cited by examiner

*Primary Examiner*—Noah P. Kamen
(74) *Attorney, Agent, or Firm*—Morgan Lewis & Bockius LLP

(57) ABSTRACT

The present invention provides an apparatus for achieving precise manufacturing of drain passages such as those used for oil return and blow-by gas discharge in a cylinder block. Grid-like oil drain passage and corresponding core structures are disclosed herein; the oil drain passage structure comprises a plurality of vertical passages that are arranged longitudinally with respect to the cylinder block, wherein the vertical passages are interconnected by a connecting passage that runs longitudinally through the central portions of the vertical passages.

3 Claims, 2 Drawing Sheets

OIL DRAIN PASSAGE STRUCTURE OF CYLINDER BLOCK AND CORE STRUCTURE THEREOF

CROSS-REFERENCE TO RELATED APPLICATIONS

This application is based on and claims priority of Korean Patent Application No. 10-2004-0109588, filed on Dec. 21, 2004, with the Korean Intellectual Property Office, the disclosure of which is fully incorporated herein by reference.

FIELD OF THE INVENTION

The present invention relates to cylinder blocks for use in engines. More particularly, the present invention relates to processes and apparatuses for forming drain passages in engine cylinder blocks.

BACKGROUND OF THE INVENTION

Cylinder block structures are well known in the art. Generally, a cylinder block contains numerous internal passages that are oriented in directions directions. Among these internal passages are oil drain passages that individually extend from an upper valley of the cylinder block to the oil pan. It follows that a mold used to cast the cylinder block should comprise a plurality of cores which form these oil drain passages.

However, a problem frequently encountered in the art involves the undesirable shifting of these passage cores upon the addition of molten metal during the casting process. As a result, the cylinder block produced has drain passages that deviate from the original design and undercuts the performance of the engine, e.g. Noise, Vibration, and Harshness (NVH) levels, and structural rigidity of the cylinder block.

SUMMARY OF THE INVENTION

The present invention provides methods and apparatuses to achieve precise manufacturing of drain passages such as those used for oil return and blow-by gas discharge in a cylinder block. Additionally, the present invention provides methods and apparatuses that improve the molding of the cylinder block, thereby forming a stable and rigid cylinder block structure which can reduce engine noise, vibration, and harshness (NVH).

In some embodiments of the present invention, an oil drain passage structure includes a plurality of vertical passages arranged longitudinally in the cylinder block, and a connecting passage runs longitudinally through the central portions of the various vertical passages so as to connect them. The apparatus for molding the cylinder block of the present invention, comprises (a) a core assembly that forms cavities for the crankcase, cylinder bores, and water jackets, (b) an outer mold that fits over the core assembly, and (c) a plurality of vertical cores arranged longitudinally and positioned in the space between the core assembly and outer mold, wherein the vertical cores are interconnected by a connecting core that runs longitudinally and is in communication with the central portions of the vertical cores.

DETAILED DESCRIPTION OF THE PREFERRED EMBODIMENTS

Figure 1:
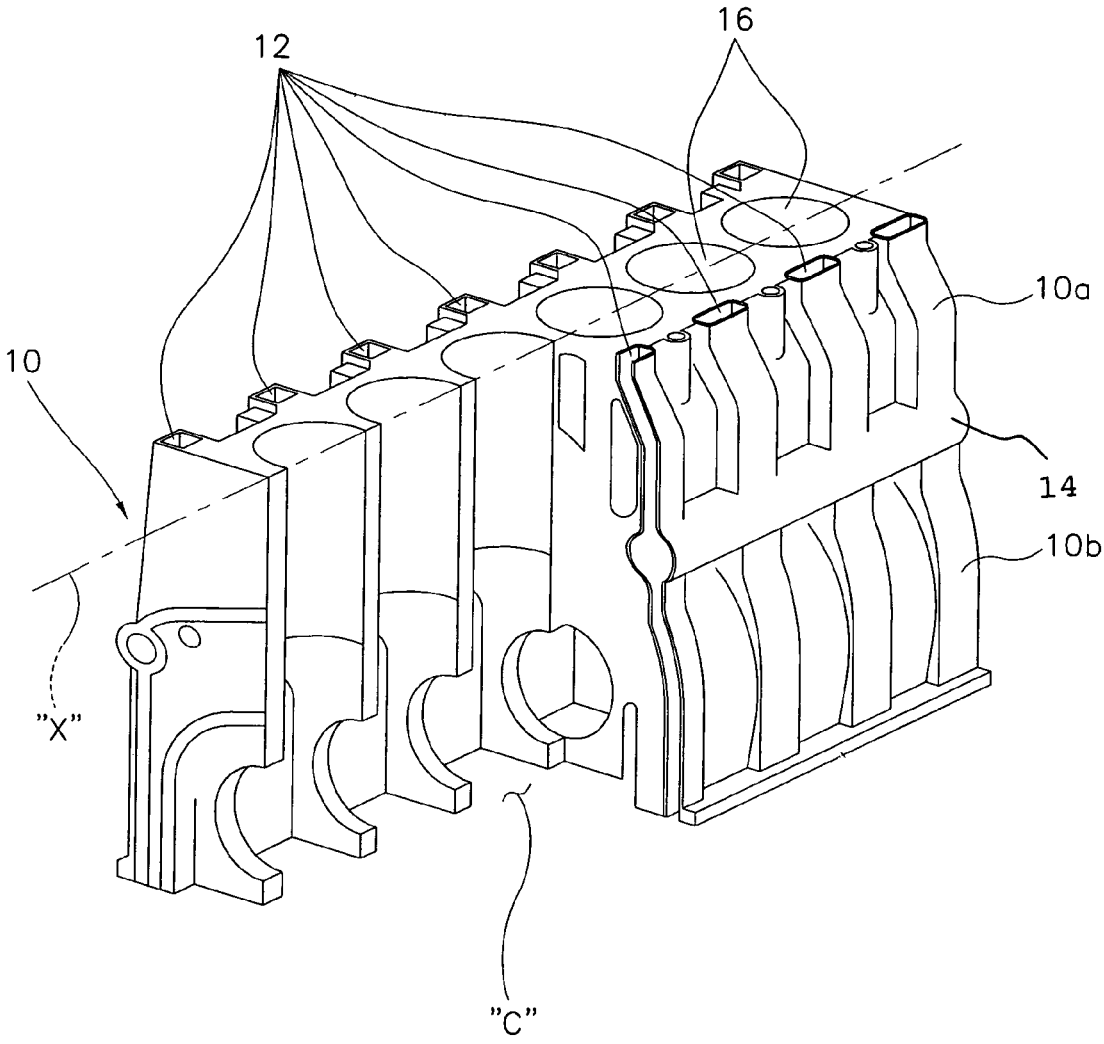
FIG. 1 illustrates a cross-sectional view of a cylinder block according to an embodiment of the present invention.

In one embodiment of the present invention as shown in FIG. 1, a plurality of drain passages, which can be used as oil drain and blow-by gas drain passages, in a cylinder block 10 are symmetrically positioned relative to a central axis (X) of cylinder block 10. The plurality of vertical cores are interconnected to form an integral truss that precisely forms an engine cylinder block which is substantially true to the original design so as to achieve the intended weight/rigidity ratio.

Figure 2:
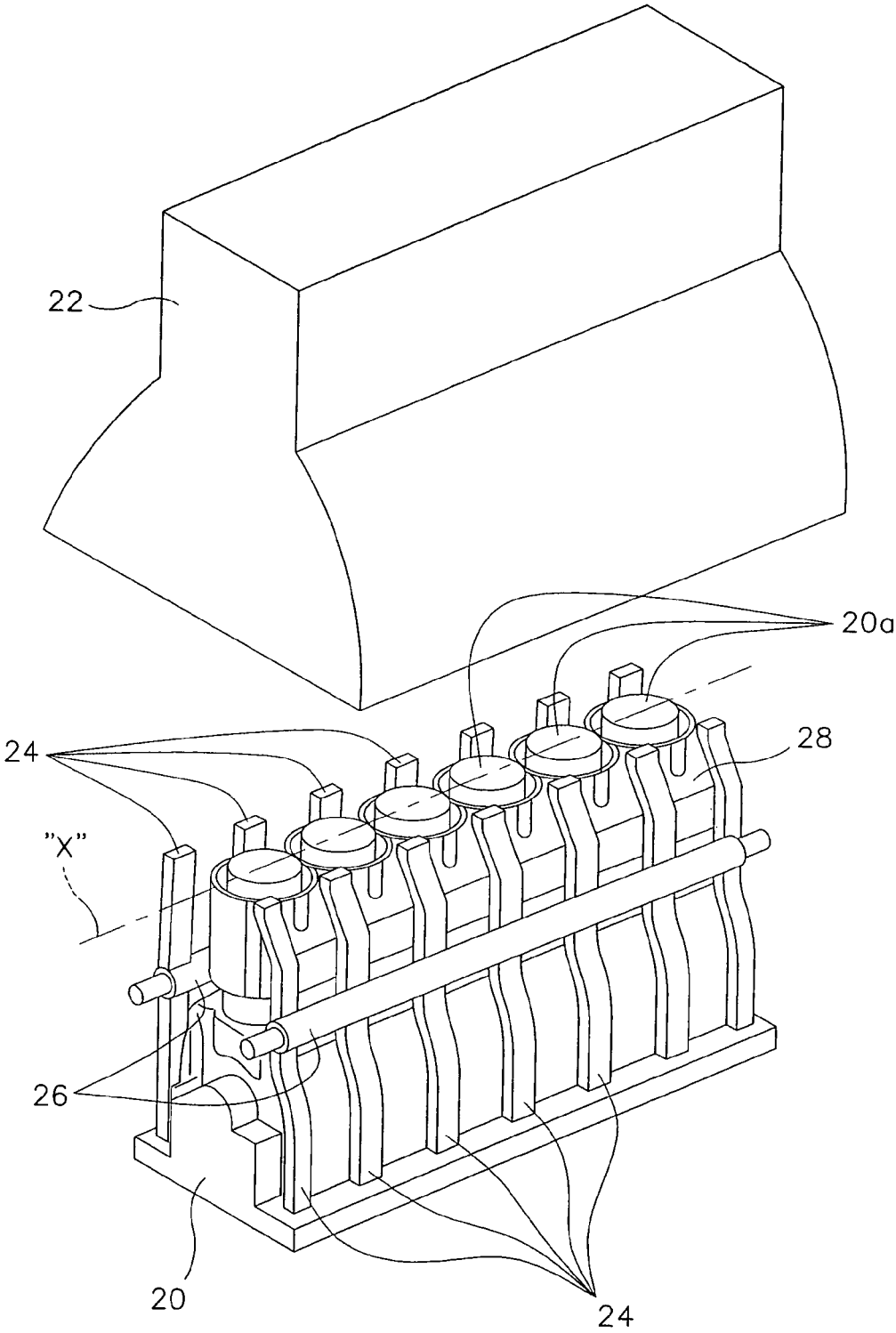
FIG. 2 illustrates an apparatus for molding the engine cylinder block according to an embodiment of the present invention, which comprises a core assembly, an outer mold, and a plurality of vertical cores interconnected by a connecting core to form the cylinder block shown in FIG. 1.

As shown in FIG. 1 and FIG. 2 and used herein, the central axis (X) of the cylinder block is a line that runs through the centers of cylinder bores 16. The structure of the oil drain passages, illustrated in FIG. 1, is characterized by a plurality of vertical passages 12 interconnected by a connecting passage 14

In some embodiments of the present invention, vertical passages 12 are arranged longitudinally in cylinder block 10 and interconnected by a connecting passage 14 which runs longitudinally through the central portions of vertical passages 12. As shown in FIG. 1, vertical passages 12 are symmetrically positioned relative to the central axis (X) of cylinder block 10 on both sides of cylinder bores 16. Each connecting passage 14 is symmetrically positioned relative to the central axis (X) of cylinder block 10 and positioned at a level between cylinder portions 10*a* (the upper portion of cylinder block 10 where cylinder bores 16 are located) and skirt portions 10*b* (where a crankcase (C) is located).

An apparatus for molding the cylinder block illustrated in FIG. 1 is shown in FIG. 2 and will be discussed in detail. In some embodiments of the present invention, the apparatus for molding or casting cylinder block 10 comprises a core assembly 20 that forms cavities for the crankcase (C), cylinder bores 16, and water jackets. Note that the portions of the core assembly 20 which form the bores 16 are labeled as 20*a*. As shown in FIG. 2, the outer mold 22 fits over the core assembly 20 to shape the outer surfaces of the engine cylinder block unit.

To form the drain passages in cylinder block 10 as provided by the present invention, a plurality of vertical cores 24 are arranged longitudinally in the cylinder block in the space between core assembly 20 and outer mold 22. In some embodiments, the vertical cores 24 are interconnected by a connecting core 26, shown in FIG. 2, that runs longitudinally through the central portions of vertical cores 24. In alternative embodiments, the connecting core 26 is joined to vertical cores 24 at their central portions but does not run through the entire width of each vertical core 24.

In some embodiments, vertical cores 24 are symmetrically positioned relative to the central axis (X) of cylinder block 10 on both sides of cores 20*a*, which are used to form cylinder bores 16, and cores 28 used to form the water jackets. A connecting core 26 is positioned at a level between cylinder portions 10*a* and skirt portions 10*b* of cylinder block 10 to interconnect vertical cores 24 on each side of the central axis (X) of core assembly 20.

A cylinder block cast using the vertical and connecting core grid structure of the present invention provides a number of advantages through the even distribution of drain passages in the cylinder block, such as improving engine oil drain function and blow-by gas discharge function. Furthermore, as the vertical passages interconnect with each other via the connecting passage, the oil drain function and blow-by gas exhaust function remain stable even when the engine is in a slanted orientation. Still further, the oil drain passages can be manufactured with extremely minimal deviation from the original design. This is extremely crucial in achieving the level of structural rigidity and NVH reduction desired in an engine and/or engine block. Another advantage of the grid-like core structure of the present invention is the stabilization of the cylinder block in the mold during the casting process. These and other objects, features, and advantages of the invention will be apparent to those of skill in the art based on this disclosure in conjunction with the accompanying drawings.

Those skilled in the art will appreciate that the conceptions and specific embodiments disclosed in the foregoing description may be readily utilized as a basis for modifying or designing other embodiments for carrying out the same purposes of the present invention. Those skilled in the art will also appreciate that such equivalent embodiments do not depart from the spirit and scope of the invention as set forth herein.

What is claimed:

1. A cylinder block structure, comprising:

(a) a plurality of cylinder bores formed in the cylinder block;

(b) a water jacket formed in the cylinder block to surround the plurality of cylinder bores; and (c) an oil drain passage structure outside the water jacket for allowing an oil to drop from a cylinder head to a crankcase therethrough, wherein the oil drain passage structure comprises:

a plurality of vertical passages arranged longitudinally with respect to said cylinder block; and a connecting passage that runs longitudinally through central portions of said vertical passages so as to interconnect said vertical passages.

2. The cylinder block structure of claim 1, wherein said vertical passages are symmetrically positioned relative to a central axis of said cylinder block and are positioned on both sides of the plurality of cylinder bores.

3. The cylinder block structure of claim 1, wherein said connecting passage is symmetrically positioned relative to a central axis of said cylinder block and is positioned between cylinder portions and skirt portions of the cylinder block.

* * * * *